US009495949B2

(12) United States Patent
Wiegel

(10) Patent No.: US 9,495,949 B2
(45) Date of Patent: Nov. 15, 2016

(54) ACOUSTIC MODULE

(71) Applicant: MUSIKON GmbH, Berlin (DE)

(72) Inventor: Thomas Wiegel, Berlin (DE)

(73) Assignee: MUSIKON GMBH, Berlin (DE)

( * ) Notice: Subject to any disclaimer, the term of this patent is extended or adjusted under 35 U.S.C. 154(b) by 0 days.

(21) Appl. No.: 14/772,119

(22) PCT Filed: Mar. 12, 2014

(86) PCT No.: PCT/DE2014/000114

§ 371 (c)(1),
(2) Date: Sep. 2, 2015

(87) PCT Pub. No.: WO2014/039499

PCT Pub. Date: Sep. 18, 2014

(65) Prior Publication Data

US 2016/0012812 A1 Jan. 14, 2016

(30) Foreign Application Priority Data

Mar. 14, 2013 (DE) ..... 10 2013 004 502

(51) Int. Cl.

| | |
|---|---|
| ***G10K 11/20*** | (2006.01) |
| ***G10K 11/16*** | (2006.01) |
| ***E04B 1/82*** | (2006.01) |
| ***G10K 11/162*** | (2006.01) |

(52) U.S. Cl.
CPC ..... *G10K 11/16* (2013.01); *E04B 1/8209* (2013.01); *G10K 11/162* (2013.01)

(58) Field of Classification Search
CPC ..... G10K 11/172; E04B 1/86
USPC ..... 181/286, 284
See application file for complete search history.

(56) References Cited

U.S. PATENT DOCUMENTS

| | | | | | |
|---|---|---|---|---|---|
| 2,882,989 | A * | 4/1959 | Bruel | E04B 1/8209 | 181/295 |
| 3,460,299 | A * | 8/1969 | Wilson | E04B 9/303 | 181/286 |
| 4,319,661 | A * | 3/1982 | Proudfoot | G10K 11/172 | 181/286 |
| 4,548,292 | A * | 10/1985 | Noxon | E04B 1/8209 | 181/286 |
| 5,137,111 | A * | 8/1992 | Diduck | E04B 1/8209 | 181/286 |
| 7,178,630 | B1 * | 2/2007 | Perdue | E04B 1/8209 | 181/290 |
| 2008/0128201 | A1 * | 6/2008 | Yamaguchi | B32B 3/266 | 181/286 |
| 2010/0175949 | A1 * | 7/2010 | Yamaguchi | G10K 11/16 | 181/286 |
| 2012/0285767 | A1 * | 11/2012 | Meyer | E04B 1/8209 | 181/286 |
| 2015/0060193 | A1 * | 3/2015 | Thun | E04B 9/34 | 181/286 |

FOREIGN PATENT DOCUMENTS

| | | | |
|---|---|---|---|
| DE | 29921869 | U | 4/2000 |
| DE | 102009004608 | A | 7/2010 |
| WO | 2009147657 | A | 12/2009 |

* cited by examiner

*Primary Examiner* — Forrest M Phillips
(74) *Attorney, Agent, or Firm* — Andrew Wilford

(57) ABSTRACT

The invention relates to an acoustic module for influencing, particularly reducing, sound reflections and/or sound transmissions in a space. The module is constructed as a three-dimensional hollow body, comprising at least one sheet material made of thin-walled flexurally elastic material, which is placed under bending stress by at least one additional sheet material so as to form a cavity, in such a manner that said thin-walled flexurally elastic material assumes a curved shape. The module is characterized by particularly good acoustic properties and can be produced economically.

11 Claims, 1 Drawing Sheet

ACOUSTIC MODULE

CROSS REFERENCE TO RELATED APPLICATIONS

This application is the US-national stage of PCT application PCT/DE2014/000114 filed 12 Mar. 2014 and claiming the priority of German patent application 102013004502.9 itself filed 14 Mar. 2013.

The present invention is directed to an acoustic module for influencing, particularly reducing, sound reflections and/or sound transmissions in a space.

Acoustic modules influence or reduce sound reflections and/or sound transmissions between areas in a space and cause particularly a sound absorption, sound dispersion and/or sound shielding. However, with the known or mainly used techniques indeed various dependencies/target conflicts consist, above all with respect to the acoustic efficiency, the manufacturing costs, the weight, the transparency, the design possibilities, the robustness, the variability etc. New solutions, as for instance transparent materials without fiber or foam materials, have not changed much with respect to this up to now.

It is the object of the present invention to provide an acoustic module of the cited kind that has good acoustic characteristics and that can be used particularly variably and that can be produced particularly economically.

According to the invention this object is achieved by an acoustic module that is formed as three-dimensional hollow body that comprises at least one two-dimensional formation of thin-walled flexible elastic material, which is placed under bending stress by at least one additional two-dimensional formation so as to form a cavity such that the thin-walled flexible elastic material assumes a curved shape.

With the inventive acoustic module at least one two-dimensional formation of thin-walled flexible elastic material is used. Such a material is characterized by assuming a curved shape when it is placed under bending stress and by returning to its original shape upon removal of the application of stress. This material can be a corresponding plastic foil or glass foil, for instance, that has a strength that provides the above-described effect.

According to the invention such a two-dimensional formation is placed under bending stress by at least one additional two-dimensional formation in such a manner that it assumes a curved shape. According to the invention an additional acoustic effect is obtained by the generation of such a tensioned condition of the two-dimensional formation as well as the maintenance of this tensioned condition (prestressed condition) according to which, for instance, the tensioned curved portion is oscillated upon the application of sound whereby a better sound absorption is obtained. Furthermore, a stability improvement of the hollow body in relation to non-tensioned two-dimensional formations is obtained by the prestress effect, i.e. with thinner material at least identical stability characteristics can be reached. Accordingly, an improvement of the acoustic effectiveness is obtained with less material.

The two-dimensional formation placed under bending stress is part of a hollow body that limits an air volume. This hollow body has not to be closed. It is essential that corresponding air masses or air layers in the hollow body are influenced by the oscillation behavior of the two-dimensional formation or its layers and parts when sound is applied.

The two-dimensional formation (sheet material) placed under bending stress can be used for the formation of a three-dimensional corpus in combination with additional two-dimensional formations wherein a variable design is possible. Such two-dimensional formations can be easily produced since they enable the construction of three-dimensional formations with smallest number of components. Known semi-finished products can be used as starting materials that can be machined precisely with known methods.

The two-dimensional formation placed under bending stress is tensioned by another two-dimensional formation and is held in this condition and assumes a stabilized three-dimensional shape. Forces applied from outside can be neutralized or cushioned well. Particularly, the object shape can autonomously regenerate after a shock, and permanent damages can be largely avoided. Since special stabilizing elements are not necessary, for instance, relatively large transparent areas without optical injury are possible. The object remains particularly light.

According to an embodiment of the invention the additional two-dimensional formation is also placed under bending stress and assumes a curved shape. Accordingly, the above-described characteristics are also true for this two-dimensional formation in this embodiment. Then the formed hollow body has at least two curved two-dimensional formations placed under bending stress. As already mentioned, the hollow body can comprise additional two-dimensional formations that are stress-free or that are also placed under bending stress so that they assume a curved shape. The connection between the individual two-dimensional formations is preferably designed such that a joint or pivot effect results. Furthermore, the acoustic module can consist of a plurality of articulated hollow bodies.

In order to obtain the desired joint or pivot effect between the individual areas connection varieties are used that generate this joint effect or that promote the same. As example for this plug-type connections are cited that are preferred.

Practically, the curved two-dimensional formation placed under bending stress has a wall thickness of <3 mm. The desired bending behavior that provides a good stability behavior with improved acoustic characteristics in contrast to a two-dimensional formation that is not prestressed is obtained with such materials. Suitable materials, especially plastic foils, are known to the expert in the art.

The curved two-dimensional formation that is placed under bending stress can have structural configurations and/or perforations, especially micro perforations, in order to modify or improve the acoustic behavior. The corresponding measures can be empirically ascertained here from case to case.

According to still another preferred embodiment the hollow body of the acoustic module comprises several hollow spaces arranged one behind the other. Accordingly, in this embodiment several air chambers or air volumes are formed that are separated from one another by the two-dimensional formations placed under bending stress. So, one can speak of multi-shell two-dimensional formations with air volumes arranged one behind the other. The inventive acoustic module is characterized by a light construction especially with this embodiment.

Accordingly, the invention provides the presuppositions for extremely light resonator cavities with definable characteristics of the limiting surfaces or further (part) surfaces connectable therewith. Furthermore, foils for the middle range and height range and the thin-walled deep-sound resonance absorbers can be combined in the extent of the same construction principle and thus broad-band absorber modules with corresponding advantages can be realized.

According to another embodiment the acoustic module according to the invention has means for varying the shape and/or tension of two-dimensional formations. With these means the acoustic characteristics of the acoustic module can be varied, for instance by alteration of the curvature of the two-dimensional formation placed under bending stress. Further design possibilities result in combination with the above-described structural configurations and/or micro perforations.

Since the acoustic modules according to the invention have an especially low weight on account of the prestressed two-dimensional formations the modules can be connected to one another with simple means. For this, the plug-type connection means already mentioned above can be used but also, for instance, clip closures etc. An assembly by means of posts, rail systems etc. can be also carried out.

The acoustic effect obtained with the acoustic modules of the invention is complex and depends, among others, on the shape of the hollow body and can be ascertained/checked by tests at the respective object. A simulation/calculation is only partly or approximately possible.

Accordingly, the acoustic module designed according to the invention is characterized by arching structures that are formed by the two-dimensional formations placed under bending stress. At least one arching structure of an acoustic module is provided by a prestressed two-dimensional formation.

The inventive acoustic module can have suitable fastening portions or fastening elements by means of which a fastening at walls, ceilings etc, also with each other, is possible. Of course, an installation free in the space individually or in combination with further modules is also possible. Moreover, a fastening at sound sources and/or light sources is possible wherein the corresponding element emitting light and/or sound can be surrounded with the acoustic module.

As connection means such means are preferred that are described in the German patent application DE 10 2009 004 608.9.

According to another embodiment the at least one two-dimensional formation includes a material formed in layers the layers of which are loosely arranged one above the other or are connected to one another. The remaining two-dimensional formations of the acoustic module can also comprise such a material. As materials, for instance, compound materials or corresponding sandwich materials are used. Materials can be also used that have several layers that are loosely arranged one above the other and that are possibly fastened to one another in a part-area-like or dot-like manner. A purely non-positive connection is also possible.

Preferably, the individual two-dimensional formations are tuned with respect to one another in order to obtain the desired acoustic characteristics. Such tunings can be realized by machining, structuring, selection of materials, material thickness etc. Depending on the tuning the effectiveness in certain frequency bands can be obtained or adjusted.

Examples for such structural configurations are indentations for the formation of tongues that can freely oscillate on account of material bending. Other examples are grooves made by material degradation that can terminate in a corresponding hole, for instance. Such structural configurations can be compared with micro perforations. It is achieved by such indentations, slots etc that certain part-areas have another oscillation behavior than the remaining part of the two-dimensional formations.

The above-described measures can be carried out on all the two-dimensional formations of the acoustic module.

Another embodiment of the invention is characterized by the feature that the acoustic module has at least one light source integrated into the module. Such a light source can be integrated into the module together with the corresponding conductor tracks, for instance.

Furthermore, acoustic actuators generating vibrations etc. as well as receptors can be integrated into the module.

As already mentioned, the two-dimensional formation placed under bending stress is part of a hollow body that limits an air volume. The hollow body can be completely or partly closed. In other words, the invention covers also open hollow bodies that can be formed as shell, for instance. Here, for instance, two curved two-dimensional formations can lie one upon the other, can be contiguously arranged or can be spaced from one another and can form a shell-like hollow body, for instance.

The additional two-dimensional formation can be formed plane or can have a three-dimensional shape. This shape can be realized in a stress-free manner, or the second two-dimensional formation can be also placed under bending stress.

All the two-dimensional formations can have structural configurations as already mentioned above. Such structural configurations can be provided with closed, partly closed or open, especially shell-like, hollow bodies.

Furthermore, the invention comprises an acoustic module that is formed by a plurality of hollow bodies lying adjacent to one another or connected to one another. These hollow bodies can be connected to one another by joint or pivot connections, for instance. Other kinds of connection are also covered by the invention.

In the following the invention is described with reference to examples in connection with the drawing in detail. Of the drawing FIG. 1 is a diagrammatic three-dimensional view of a first embodiment of an acoustic module;

Figure 1:
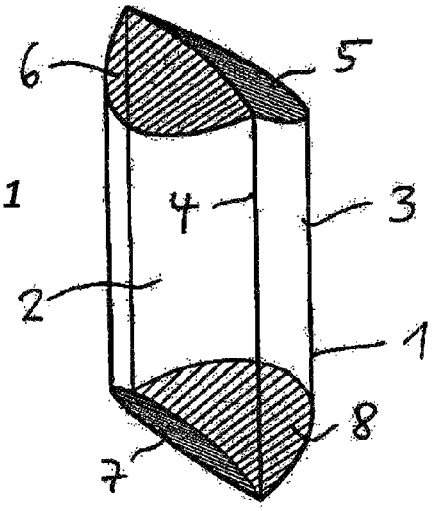

The acoustic module 1 shown in FIG. 1 consists of collectively seven two-dimensional formations (sheets) of which three two-dimensional formations 2, 3 and 4 correspond to part-cylindrical surfaces. The part-cylindrical surfaces 2 and 3 are placed under bending stress by the part-cylindrical two-dimensional formation 4 that is connected to the two-dimensional formations 2, 3 in the edge portions and places the same under bending stress by this. Furthermore, the acoustic module 1 has four additional two-dimensional formations 5, 6, 7 and 8 that are formed as part-cone surfaces. These two-dimensional formations form the upper and lower end of the acoustic module that thus is composed of two hollow bodies that are separated from one another by the central two-dimensional formation 4. Accordingly, two air volumes arranged one behind the other are provided.

The two two-dimensional formations 2, 3 placed under bending stress care for the desired acoustic characteristics. Accordingly, the whole acoustic module consists of seven two-dimensional formations connected to one another and each consisting of a flexible elastic plastic foil of a thickness <3 mm.

Figure 2:
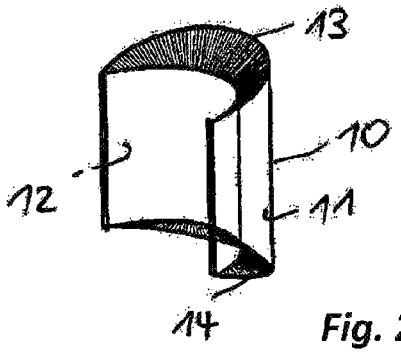
FIG. 2 is a view corresponding to FIG. 1 of a second embodiment of an acoustic module.

The acoustic module 10 diagrammatically shown in FIG. 2 consists of two part-cylindrical two-dimensional formations 11, 12 and two part-cone surfaces 13, 14. The two-dimensional formation 11 is placed under bending stress by the two-dimensional formation 12. The two two-dimensional formations 13, 14 form the upper and lower end of a hollow body so that a closed air volume results. The acoustic module can consist of a corresponding material as the module of FIG. 1.

Figure 3:
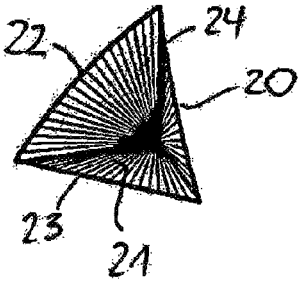
FIG. 3 is a view corresponding to FIG. 1 of a third embodiment of an acoustic module.

In the embodiment of an acoustic module 20 shown in FIG. 3 the module consists of a spherically arched two-dimensional formation 21 and three part-cone surfaces 22, 23 and 24 that form together a hollow body with a closed air volume. The spherically arched two-dimensional formation 21 as well as the three part-cone surfaces 22, 23, 24 are placed under bending stress.

Figure 4:
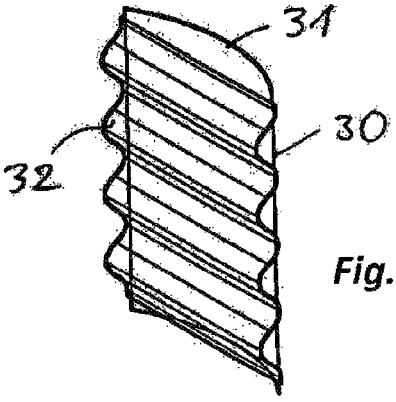
FIG. 4 is a view corresponding to FIG. 1 of a fourth embodiment of an acoustic module.

FIG. 4 shows an acoustic module 30 consisting of a part-cylindrical two-dimensional formation 31 and a corrugated two-dimensional formation 32 that are connected to one another. Both two-dimensional formations form a hollow body with a partly enclosed air volume. The part-cylindrical two-dimensional formation 31 is placed under bending stress by the corrugated two-dimensional formation 32.

The materials for the acoustic modules of FIGS. 2 to 4 can correspond to materials of the module of FIG. 1.

The acoustic modules only diagrammatically shown here can be fastened with non-shown fastening means at walls, ceilings etc., for instance, or can be installed in a space by suitable positioning means (not shown).

Figure 5:
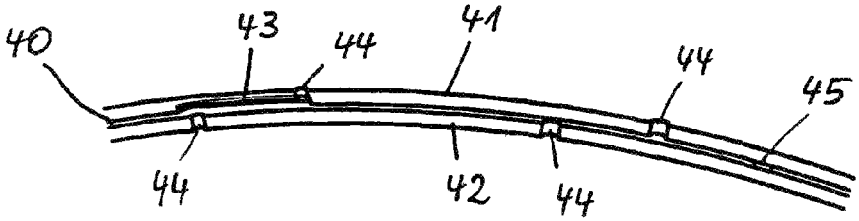
FIG. 5 is a sectional view of a part of a two-dimensional formation.

FIG. 5 shows a section through a part of a two-dimensional formation 40 of thin-walled flexible elastic material. Here, the material consists of two layers 41, 42 arranged one on the other that are fixed to one another by connection points 45 or corresponding spacers in a spaced condition. Spaced perforations 44 are arranged in both layers 41, 42. Furthermore, a groove 43 formed by the degradation of material is provided on the inner side of the layer 41 and terminates in a perforation 44. With the structures (perforations, grooves etc.) shown here corresponding acoustic effects are obtained.

Figure 6:
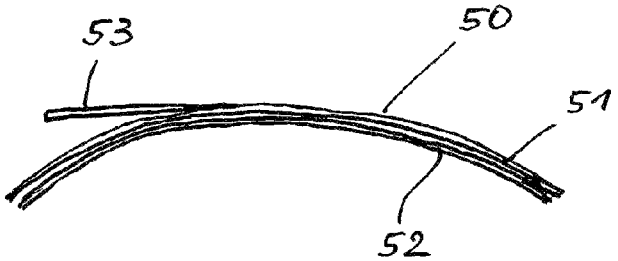
FIG. 6 is a diagrammatic representation of a two-dimensional formation provided with tongues.

FIG. 6 shows a diagrammatic representation of a two-dimensional formation 50 placed under bending stress that consists of two plastic foils 51, 52 tensioned one above the other in this embodiment. Both foils are not connected with one another but only braced.

The upper foil 51 has indentations by which tongues 53 are formed that project from the curved foil 51 and have a corresponding oscillation behavior upon an acoustic application.

The invention claimed is:

1. An acoustic module for reducing sound reflections or sound transmissions in a space, comprising:

an at least partly closed three-dimensional hollow body capable of limiting air flow and formed by at least one primary two-dimensional formation of thin-walled flexible elastic material and having structural configurations in the form of micro perforations, and at least one secondary two-dimensional formation putting the primary two-dimensional formation under bending stress so as to form a closed space and deform the thin-walled flexible elastic material into a curved shape.

2. The acoustic module according to claim 1, wherein the secondary two-dimensional formation is also placed under bending stress and assumes a curved shape.

3. The acoustic module according to claim 1, wherein the hollow body includes tertiary two-dimensional formations that are stress-free or that are also placed under bending stress so that they assume a curved shape.

4. The acoustic module according to claim 1, further comprising:

a plurality of jointly connected such hollow bodies.

5. The acoustic module according to claim 1, wherein the connection between the two-dimensional formations is designed such that a joint effect results.

6. The acoustic module according to claim 1, wherein the primary and secondary two-dimensional formations are connected to one another by plug-type connections.

7. The acoustic module according to claim 1, wherein the curved two-dimensional formation placed under bending stress has a wall thickness of <3 mm.

8. The acoustic module according to claim 1, wherein the hollow body has several closed spaces arranged one behind the other.

9. The acoustic module according to claim 1, further comprising:

means for altering the shape or tension of the two-dimensional formations.

10. The acoustic module according to claim 1, wherein the at least one two-dimensional formation includes a material formed in layers that are loosely disposed one upon the other or are connected to one another.

11. The acoustic module according to claim 1, further comprising:

at least one light source integrated into the module.

* * * * *